United States Patent [19]

Williams

[11] 4,047,973

[45] Sept. 13, 1977

[54] RECOVERY OF SELENIUM AND SELENIUM ALLOYS BY HYDRAULIC LATHING

[75] Inventor: John K. Williams, Fairport, N.Y.

[73] Assignee: Xerox Corporation, Stamford, Conn.

[21] Appl. No.: 736,056

[22] Filed: Oct. 27, 1976

[51] Int. Cl.[2] ..... B08B 3/02; B08B 11/00

[52] U.S. Cl. ..... 134/10; 96/1 R; 134/26; 134/33; 134/34

[58] Field of Search ..... 134/10, 26, 33, 34, 134/42; 96/1 R; 423/509, 510

[56] References Cited

U.S. PATENT DOCUMENTS

| | | | |
|---|---|---|---|
| 3,489,608 | 1/1970 | Jacobs et al. | 134/33 X |
| 3,868,272 | 2/1975 | Tardoskegyi | 134/26 |
| 3,970,471 | 7/1976 | Bankes et al. | 134/33 X |
| 3,992,511 | 11/1976 | Waehner et al. | 423/510 |

*Primary Examiner*—Richard V. Fisher
*Attorney, Agent, or Firm*—James J. Ralabate; James P. O'Sullivan; Jerome L. Jeffers

[57] ABSTRACT

The present invention is a method for recovering selenium or an alloy thereof from the surface of an endless xerographic belt which comprises a ductile metal substrate having on its outer surface a thin layer of an organic resinous material which is overcoated with a relatively thicker layer of selenium or a selenium alloy. The method comprises the steps of:

1. mounting the belt on a rigid mandrel having a ribbed outer surface;
2. subjecting the surface of the belt to one or moe jets of high pressure water, said jets being expelled from one or more nozzles at a pressure of from about 8,000 to 11,000 pounds per square inch, to strip the selenium or selenium alloy from the belt without substantially affecting the layer of organic resinous material. During this step a water slurry of selenium is formed;
3. the last step of the method involves removing the water from the slurry to obtain substantially pure selenium or an alloy thereof.

7 Claims, 1 Drawing Figure

RECOVERY OF SELENIUM AND SELENIUM ALLOYS BY HYDRAULIC LATHING

BACKGROUND OF THE INVENTION

This invention relates to electrostatographic copying and more specifically to a method of recovering selenium and/or selenium alloys from endless xerographic belts.

The art of xerography involves the use of a photoconductive element, i.e. drum or plate, which is uniformly electrostatically charged in order to sensitize its surface. The plate is then exposed in an imagewise manner to activating electromagnetic radiation which selectively dissipates the charge in the exposed areas of the photoconductive material while leaving behind a latent electrostatic image in the non-exposed areas. This latent electrostatic image may then be developed by depositing a finely divided electroscopic marking material on the surface of the photoconductive material. This concept was originally disclosed by C. F. Carlson in U.S. Pat. No. 2,297,691 and is further amplified and described in many related patents.

Xerographic drums of a conductive substrate such as aluminum with a layer of a photoconductive material such as amorphous selenium on and in operative contact with its surface have been used for many years. More recently, the endless xerographic belt has been used in xerographic duplication. The endless xerographic belt must be flexible and is preferably seamless. Suitable belts are quite thin and have a surface with a high degree of smoothness due to the need for the production of high quality images on the image retention side of the belt. A further requirement is that the belt have a relatively high tensile strength. Satisfactory belts can be prepared by electroplating a ductile metal, e.g., stainless steel, brass, aluminum or nickel, onto a mandrel to form a thin, uniform layer of the metal. Removal of the metal layer from the mandrel provides the substrate upon which the photoconductive material can be deposited to form the xerographic belt.

Xerographic photoreceptors, whether they be in the form of a drum or belt, normally have a barrier layer between the conductive substrate and the layer of photoconductive material to prevent charge injection from the conductive substrate in the dark. When the substrate used is an aluminum drum, a thin layer of aluminum oxide, formed by oxidizing the surface of the drum, serves well as the blocking layer. When the substrate is an endless belt, it has been found that a thin, normally sub-micron layer of an insulating organic resin is desirable for use as the blocking layer. Typically, the organic barrier layer used is a polymer blend of a polycarbonate and polyurethane resins in a ratio of about 7 parts by weight polycarbonate to 1 part by weight polyurethane. After application of the organic blocking material to the substrate, amorphous selenium or an alloy thereof is applied by vacuum deposition.

Belts made in this manner serve admirably in high speed xerographic duplicators but, of course, wear out over extended periods of use. When a belt wears out, sound economics dictates that the selenium or selenium alloy be recovered and recycled. Various methods are available for stripping selenium from the substrate. These include heat stripping, water quenching, ultrasonics and bead blasting. These processes, however, are not readily adaptable to the previously described xerographic belt because of the presence of the organic interface on the flexible metal substrate. Stripping selenium by these processes also strips part of the organic material thereby contaminating the recovered selenium. Cold shocking the belt, such as by dipping it in liquid nitrogen, removes the selenium without affecting the organic interface, but is inherently a two step process; the first step being a liquid nitrogen dip and the second step consisting of mechanical vibration or shaking.

It would be desirable, and it is an object of the present invention, to provide a novel method for recovering selenium or selenium alloy from the surface of a xerographic belt comprising a ductile metal substrate having a thin layer of an organic resinous material on its surface which is in turn overcoated with selenium.

A further object is to provide such a process which yields recovered selenium of high purity which is not contaminated with the organic resinous material.

An additional object is to provide such a process which strips the selenium from the belt in a single step.

SUMMARY OF THE INVENTION

The present invention is a method for recovering selenium or a selenium alloy from the surface of an endless, flexible, xerographic belt comprising a ductile metal having on its outer surface a thin layer of an organic resinous material which is overcoated with a relatively thicker layer of selenium or a selenium alloy. The method comprises the consecutive steps of:

1. mounting the belt on a rigid mandrel having a ribbed outer surface;
2. subjecting the surface of the belt to one or more jets of high pressure water, said jets being expelled from one or more nozzles at a pressure of from 8,000 to 11,000 pounds per square inch to strip the selenium or selenium alloy from the belt without substantially affecting the layer or organic resinous material to thereby form a water slurry of selenium or selenium alloy; and
3. recovering the water slurry and removing the water to obtain substantially pure selenium or selenium alloy.

DETAILED DESCRIPTION AND PREFERRED EMBODIMENTS

Figure 1:
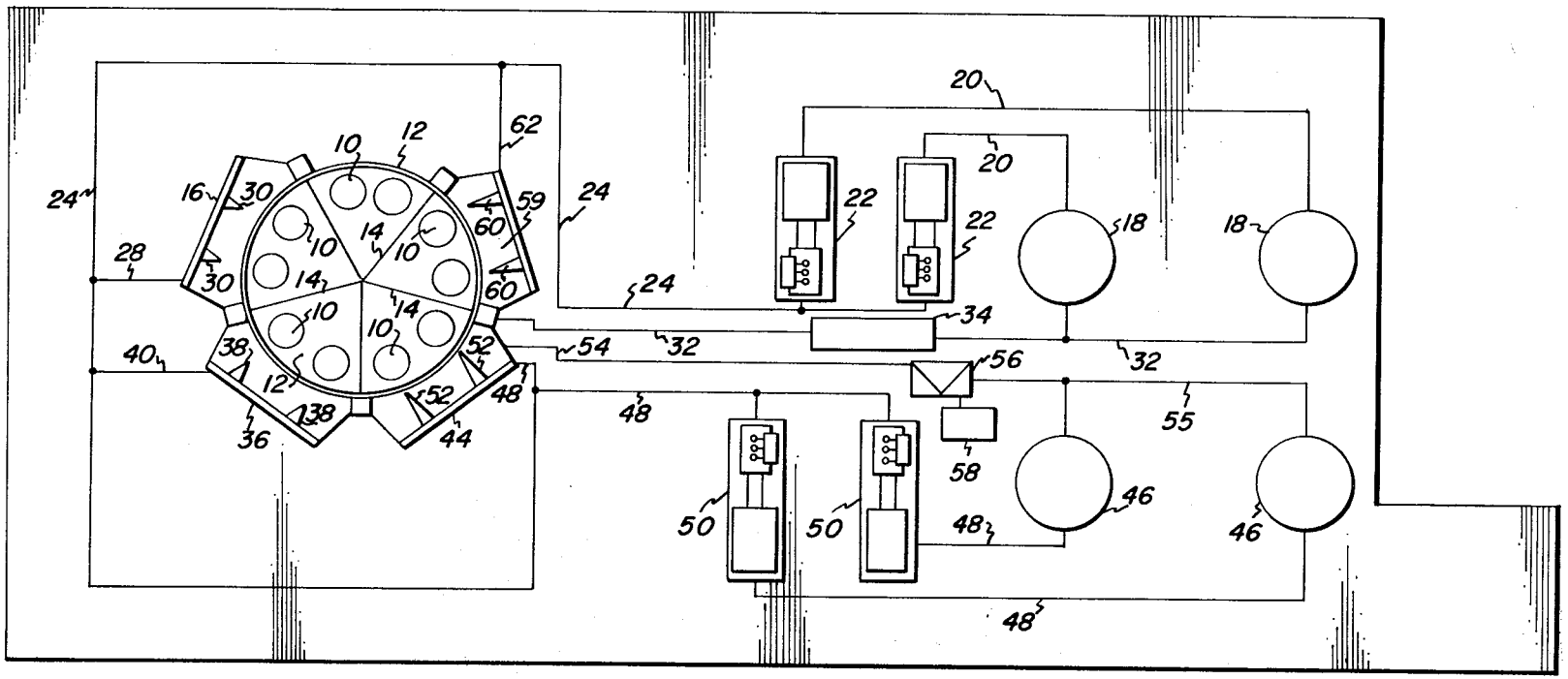

The preferred method of practicing the present invention is more fully set out in FIG. 1. The xerographic belts mounted on non-resilient mandrels, generaly designated as 10, are placed on turntable 12. The turntable is open at is periphery with its surface being divided into five chambers or booths by vertical walls 14. The xerographic belts are placed on the turntable at the 12 o'clock position. The turntable is then rotated 72° in order to bring the belts into alignment with the first booth designated as 16. Water is pumped from holding tanks 18 through lines 20 by high pressure pumps 22 into vessel 24. This vessel contains a number of separate water lines, the utility of which will be apparent from the following description. The water is routed through vessel 24 into line 28 and exits through nozzles 30. While the water spraying is being carried out, the belts on their mandrels are mechanically rotated in a clockwise direction. In addition, the water nozzles are moved vertically along the entire height of the mandrel bearing the belt. This movement is synchronized so that every portion of the drum is contacted with the water jet. The first water spraying, carried out at relatively low pressure, e.g., 60 to 80 p.s.i., is designed to remove organic contaminates from the belt. These contaminates include toner particles carried over from the use of the belt in the xerographic copying process. The top and bottom of the belt is contacted with a water spray of about 6,000 p.s.i. to remove the resinous coating placed along each edge of the belt to prevent the causation of injuries because of their sharpness. The water recovered from this procedure is recovered from the sump located under the turntable (not shown) and pumped back to holding tanks 18 via line 32 which passes it through mechanical filtration device 34. At this point, turntable 12 is rotated another 72° so that the chamber bearing the partially stripped belt is in alignment with the second booth designated as 36. Additional water is sprayed from nozzles 38 which is supplied from line 40 emanating from vessel 24. This step is merely a rinsing operation to ensure that the chamber is free of organic material before the selenium stripping operation begins. The water used in this step is recycled as is that used in the first step.

The turntable is now rotated an additional seventy-two degrees so that the partially treated belts come in alignment with the third booth designated as 44. It is in this booth where the selenium or selenium alloy is stripped from the metallic substrate. Water is pumped from the second set of holding tanks 46 through line 48 by pumps 50 through high pressure nozzles 52. As in the first step, the belts are rotated clockwise and the nozzles moved vertically up and down the width of the belt to apply the jet of water of every portion of its surface. This mode of operation can be thought of as a hydraulic lathing operation. As previously mentioned, this step of the process is subject to certain limitations because it is important to remove the selenium layer without affecting the layer of resinous material which lies beneath it. In this regard, it has been found that the water pressure as it exits nozzles 52 should be in the range of from about 8,000 to 11,000 pounds per square inch. Pressures substantially below 8,000 p.s.i. remove little or no selenium from the drum whereas pressure substantially above 11,000 p.s.i. strip the selenium and organic interface totally. Additionally process parameters that have been found to work well involve placing the nozzle from 2 to 4 inches from the selenium surface, providing a water flow rate of from 13 to 16 gallons per minute and providing about 24 seconds for the reciprocation of the nozzle from the top to bottom of the drum while the mandrel rotates at 300 rpm.

In order to achieve substantially complete removel of the selenium, it is essential that the mandrel on which the belt is mounted has a ribbed surface consisting of intermittent lands end valleys. It has been discovered that such a surface is beneficial in that it permits the belt to flex during the application of the high pressure water thereby causing the selenium layer to flake off. It is preferred that the ribs not be raised more than about 40 mils from the main surface of the mandrel since too great an elevation can result in breaking of the metal substrate thereby permitting some of the organic layer to chip off. Typically, the ribs are raised from about 30 to 40 mils. In addition, best results in terms of selenium removal are achieved when the distance between ribs is from about 31 to 62 mils. A quilted pattern of lands and valleys on the mandrel is especially desirable.

Use of a ribbed mandrel and application of high pressure water as previously described results in removal of at least about 97 percent of the selenium from the belt in the third booth to form a selenium slurry. The water slurry of selenium is pumped through line 54 to cyclone separator 56 where the selenium slurry is partially dewatered. The recovered water is returned to holding tank 46 via line 55. The now concentrated selenium slurry is passed from the cyclone separator 56 to a centrifuge then to vacuum chamber 58 where the remaining moisture is removed. The dried selenium is then placed in containers for shipping.

The belts on the turntable are now essentially stripped of their selenium. However, it is necessary to strip the last vestigages of selenium from them in order for the metal substrate to be recyclable. This is accomplished in booth 4 designated as 59 in FIG. 1. In this booth, the belts are treated essentially the same as in booth 36 except that the water flow is reduced by about one half and the reciprocating nozzles 60 are programmed to concentrate on the upper and lower ends of the belt since this is where residual selenium has been found to congregate. Water is directed to the fourth booth through line 62 which emanates from vessel 24. Recovered water passes through line 32 and is mechanically filtered before returning it to holding tanks 18.

At this point, the turntable rotates back to its original position where the stripped belts are removed for metal reclamation and replaced with other used belts which undergo the cycle as previously described. While the various steps have been described sequentially, it is apparent that they can occur simultaneously and would typically be so carried out.

The reclamation process of the instant invention can be employed to recover pure selenium and works equally well when the xerographic belt bears a selenium alloy such as selenium/arsenic or selenium/tellurium as the photoconductor.

The method of practicing the invention is further disclosed by the following example.

EXAMPLE

An endless, flexible, nickel belt, 0.0045 inch thick, 16½ inches wide and 65 inches in circumference is provided. The belt has on its surface a submicron layer of the blend of polycarbonate and polyurethane resin previously described with an alloy comprising greater than 99% selenium, less than ½% arsenic and about 100 p.p.m. chlorine on its surface.

The belt is mounted on a 19½ inch high expandable mandrel having on its outer surface a one piece, 17–7 P.H. stainless steel sleeve which has been passivated for corrosion resistance. The stainless steel sleeve has parallel ribs on its surface which are 1/16 inch in width with 1/16 inch valleys between them. The ribs protrude 0.035 ± 0.005 inch from the surface of the sleeve. The mandrel is expanded by means of air chucks to firmly secure the xerographic belt. The mandrels are rotated at 300 rpm during the subsequent operations with the water nozzles being mounted on reciprocating shafts designed to transverse the height of the mandrel every 24 seconds.

Xerographic toner is removed from the belt by a 60 p.s.i. water spray through a 13/64 inch nozzle. The flow rate for this step is 10 gallons per minute. The previously described resinous edge protector is then removed by a 6,000 p.s.i., 8 G.P.M. water spray projected through a 0.060 inch nozzle.

The next step of the operation involves a thorough washing of the belt by the use of a 60 p.s.i., 30 G.P.M. water spray projected through a 9/64 inch nozzle.

At this point, the belt's surface is subjected to a 10,000 p.s.i., 15 G.P.M. spray through a 0.080 inch nozzle and a second 60 p.s.i., 30 G.P.M. wash. This operation creates a water slurry containing the stripped selenium. It is found that greater than 97% of the selenium alloy is stripped from the belt and that which is stripped is found to be greater than 99% pure.

The final step involves feathering the belt edges by use of a 12,000 p.s.i., 17 G.P.M. spray through a 0.080 inch nozzle to remove any remaining alloy and prepare the nickel substrate for reclamation.

In each step of the foregoing operation the reciprocating nozzles are programmed to make a single pass along the height of the mandrel. Recirculation of used water, recovery of selenium from the water slurry, etc., is accomplished as is described in the explanation of FIG. 1.

What is claimed is:

1. A method of recovering selenium or a selenium alloy from the surface of an endless, flexible, xerographic belt comprising a ductile metal substrate having on its outer surface a thin layer of an organic resinous material which is overcoated with a relatively thicker layer of selenium or a selenium alloy which method comprises the consecutive steps of:

a. mounting the belt on a rigid mandrel having a ribbed outer surface;

b. subjecting the surface of the belt to one or more jets of high pressure water, said jets being expelled from one or more nozzles at a pressure of from about 8,000 to 11,000 pounds per square inch to strip the selenium or selenium alloy from the belt without substantially affecting the layer of organic resinous material to thereby form a water slurry of selenium or selenium alloy; and c. recovering the water slurry and removing the water to obtain substantially pure selenium or selenium alloy.

2. The method of claim 1 wherein the ductile metal is stainless steel, brass, aluminum or nickel.

3. The method of claim 1 wherein the layer of organic resinous material is a blend of polycarbonate and polyurethane resins in a ratio of about 7 parts by weight polycarbonate to 1 part by weight polyurethane.

4. The method of claim 1 wherein the xerographic belt is cleaned by subjecting it to a 60–80 p.s.i. water spray before stripping the selenium or selenium alloy.

5. The method of claim 1 wherein the ribs on the surface of the mandrel are raised no more than about 40 mils from its main surface.

6. The method of claim 5 wherein the ribs are raised from 30 to 40 mils.

7. The method of claim 1 wherein the distance between the ribs is 31 to 62 mils.

* * * * *